US011765520B2

(12) United States Patent
Kervran

(10) Patent No.: US 11,765,520 B2
(45) Date of Patent: Sep. 19, 2023

(54) DIFFERENTIAL CONDENSER MICROPHONE

(71) Applicant: AAC Acoustic Technologies (Shenzhen) Co., Ltd., Shenzhen (CN)

(72) Inventor: Yannick Pierre Kervran, HK (FR)

(73) Assignee: AAC Acoustic Technologies (Shenzhen) Co., Ltd., Shenzhen (CN)

( * ) Notice: Subject to any disclaimer, the term of this patent is extended or adjusted under 35 U.S.C. 154(b) by 13 days.

(21) Appl. No.: 17/553,814

(22) Filed: Dec. 17, 2021

(65) Prior Publication Data

US 2023/0199407 A1 Jun. 22, 2023

(51) Int. Cl.
*H04R 19/04* (2006.01)
*H04R 7/18* (2006.01)
*H04R 1/04* (2006.01)

(52) U.S. Cl.
CPC ..... *H04R 1/04* (2013.01); *H04R 7/18* (2013.01)

(58) Field of Classification Search
CPC ..... H04R 19/04; H04R 7/18; H04R 2201/003
See application file for complete search history.

(56) References Cited

U.S. PATENT DOCUMENTS 11,516,569 B1 * 11/2022 Kervran ..... H04R 7/16

FOREIGN PATENT DOCUMENTS

KR 2121695 B1 * 6/2020 ..... H04R 19/005

* cited by examiner

*Primary Examiner* — Sunita Joshi
(74) *Attorney, Agent, or Firm* — W&G Law Group

(57) ABSTRACT

A differential condenser microphone is provided, including: a base having a cavity passing through the base; a diaphragm connected to the base and covering the cavity; a mounting portion connected to the diaphragm through a connector, movable electrodes protruding from an outer edge of the mounting portion; first fixed electrodes connected to the base, the first fixed electrodes and the movable electrodes are spatially separated from and cross each other; second fixed electrodes connected to the base, the second fixed electrodes and the movable electrodes are separated from and cross each other, and the first fixed and second fixed electrodes are arranged opposite to and spaced from each other along vibration direction of the diaphragm. Compared to the related art, the microphone can achieve higher sensitivity, higher signal-to-noise ratio, better capacity in suppressing linear distortion, and improve anti-interference capacity, thereby achieving longer signal transmission distance and better audio performance.

11 Claims, 10 Drawing Sheets

DIFFERENTIAL CONDENSER MICROPHONE

TECHNICAL FIELD

The present invention relates to the field of microphone technologies and, in particular, to a differential condenser microphone.

BACKGROUND

With the development of wireless communication, there are more and more mobile phone users in the world. Users are having higher requirements on high-quality call, especially with the current development of mobile multimedia technology, the quality of the call is more important than ever. Since a microphone is used as a voice pickup device of the mobile phone, its design directly affects the quality of the call.

At present, a Micro-Electro-Mechanical-System (MEMS) microphone with wider application and better performance is as shown in FIG. 1, which shows a schematic diagram of a cross section of a microphone in the related art. The microphone 10 includes a backplate 11 and a diaphragm 12 opposite to the backplate 11 and connected by a connecting portion 121. The diaphragm 12 can vibrate up and down relative to the backplate 11. The backplate 11 is provided with sound holes 111, through which sound airflow is transmitted to the diaphragm 12 to cause the diaphragm 12 to vibrate. A sound cavity 13 is formed between the diaphragm 12 and the backplate 11. The diaphragm 12 and the backplate 11 are respectively provided with conductive layers and can be energized, but the energized parts are insulated from each other. As such, the diaphragm 12 and the backplate 11 form a capacitor. However, since the value of the capacitor is directly proportional to an area between the two plates of the capacitor and inversely proportional to a distance between the two plates of the capacitor, the microphone diaphragm 12 of this structure may be greatly deformed by the interference of an electric field force. The distance between the diaphragm 12 and the backplate 11 changes in a curve, so the condenser microphone of this structure has poor linearity and, as a result, the microphone has poor sensitivity, poor frequency response, and high noise.

SUMMARY

The present invention provides a differential condenser microphone, to solve the technical problems in the related art.

The present invention provides a differential condenser microphone, including: a base having a cavity passing through the base; a diaphragm connected to the base and covering the cavity; a mounting portion connected to the diaphragm through a connector, wherein a plurality of movable electrodes protrudes from an outer edge of the mounting portion; a plurality of first fixed electrodes connected to the base, wherein the plurality of first fixed electrodes and the plurality of movable electrodes are spatially separated from, cross and face each other; and a plurality of second fixed electrodes connected to the base, wherein the plurality of second fixed electrodes and the plurality of movable electrodes are separated from, cross and face each other, the plurality of first fixed electrodes and the plurality of second fixed electrodes are arranged opposite to and spaced from each other along a vibration direction of the diaphragm.

As an improvement, opposite ends of the connector are connected to a center of the mounting portion and a center of the diaphragm, respectively.

As an improvement, the differential condenser microphone further includes a connection ring, wherein an axis of the connection ring coincides with an axis of the connector, and opposite ends of the connection ring are connected to the diaphragm and the mounting portion, respectively.

As an improvement, the plurality of first fixed electrodes is provided on an end surface of the base through a first support arm, the plurality of second fixed electrodes is provided on the end surface of the base through a second support arm, and the plurality of first fixed electrodes is arranged closer to the diaphragm than the plurality of second fixed electrodes.

As an improvement, both the plurality of first fixed electrodes and the plurality of second fixed electrodes are fixed on a wall surface of the cavity, and the plurality of first fixed electrodes is closer to the diaphragm than the plurality of second fixed electrodes along the vibration direction of the diaphragm.

As an improvement, the differential condenser microphone further includes a backplate connected to the base by a spacer to form a set gap with the diaphragm, wherein a plurality of sound holes is provided penetrating through the backplate.

As an improvement, the plurality of first fixed electrodes one-to-one corresponds to the plurality of second fixed electrodes.

As an improvement, one of the plurality of first fixed electrodes and one of the plurality of second fixed electrodes are arranged between any adjacent two of the plurality of movable electrodes.

As an improvement, the movable electrode has a same distance to two adjacent first fixed electrodes and has a same distance to two adjacent second fixed electrodes.

As an improvement, the plurality of first fixed electrodes and the plurality of second fixed electrodes have a same thickness along the vibration direction of the diaphragm.

As an improvement, each of the plurality of first fixed electrode comprises a first top surface and a first bottom surface that are opposite to each other along the vibration direction of the diaphragm; each of the plurality of second fixed electrode comprises a second top surface and a second bottom surface that are opposite to each other along the vibration direction of the diaphragm; each of the plurality of movable electrode comprises a third top surface and a third bottom surface that are opposite to each other along the vibration direction of the diaphragm; the first top surface, the third top surface and the second top surface are sequentially arranged along a direction facing away from the diaphragm.

As an improvement, the diaphragm has a shape in central symmetry.

As an improvement, the shape of the diaphragm is a circle or a square.

Compared to the related art, the first capacitor is formed by the first fixed electrodes and the movable electrodes, and the second capacitor is formed by the second fixed electrodes and the movable electrodes. The first electrical signal output by the first capacitor and the second electrical signal output by the capacitor form a differential output. The dual capacitor electrical signal differential output mode of the condenser microphone of the present invention can greatly increase the sensitivity and a better capacity in suppressing linear distortion, so that the condenser microphone obtains a higher signal-to-noise ratio, better capacity in suppressing linear distortion, and at the same time improves anti-interference capacity of the microphone, thereby achieving longer signal transmission distance and better audio performance of the microphone.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present invention. Moreover, in the drawings, like reference signs designate corresponding parts throughout the several views.

LIST OF REFERENCE SIGNS

Figure 1:
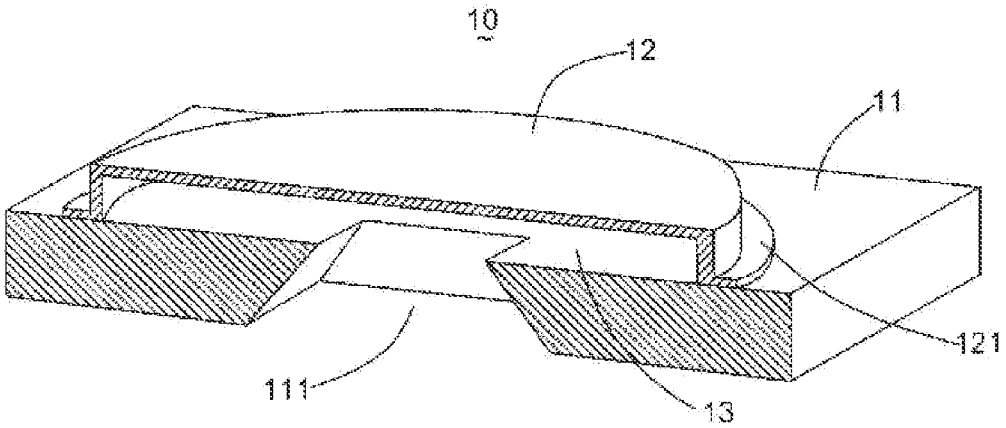
FIG. 1 (Prior Art)
FIG. 1 is a cross-sectional view of a microphone in the related art.

In the present invention:

1—base, 11—cavity, 2—diaphragm, 3—mounting portion, 31—connector, 32—connection ring, 4—first fixed electrode, 41—first top surface, 42—first bottom surface, 43—first support arm, 5—second fixed electrode, 51—second top surface, 52—second bottom surface, 53—second support arm, 6—movable electrode, 61—third top surface, 62—third bottom surface, 7—backplate, 71—sound hole, 72—spacer;

In the related art:

10—microphone, 11—backplate, 111—sound hole, 12—diaphragm, 121—connecting portion, 13—sound cavity.

DESCRIPTION OF EMBODIMENTS

Embodiments of the present invention are described in detail below. Examples of the embodiments are shown in the accompanying drawings, in which the same or similar reference signs indicate the same or similar elements or elements having the same or similar functions. The embodiments described below with reference to the drawings are only exemplary and are used to explain the present invention, and shall not be interpreted as limitations to the present invention.

As shown in FIGS. 2-5, an embodiment of the present invention provides a differential condenser microphone, including: a base 1, a diaphragm 2, a mounting portion 3, a plurality of first fixed electrodes 4, a plurality of second fixed electrodes 5, and a plurality of movable electrodes 6.

A cavity 11 is formed passing through the base 1. Optionally, an inner contour surface of the cavity 11 is a circular structure.

The diaphragm 2 is connected to the base 1 and covers the cavity 11. In this embodiment, the shape of the diaphragm 2 is not limited to a circle, and may also be a square or other shapes in central symmetry.

The mounting portion 3 is connected to the diaphragm 2 through a connector 31, and the mounting portion 3 is provided in an axial direction of the diaphragm 2 and maintains a predetermined gap with the diaphragm 2. The shape of the mounting portion 3 is the same as the shape of the diaphragm 2, and may be slightly smaller in size than the diaphragm 2. In other embodiments, the shape of the mounting portion 3 and the shape of the diaphragm can be different. For example, the diaphragm can be circular and the mounting portion can be a square. The shape of the diaphragm and mounting portion can be set according to the specific requirements, which is not limited in the application. The plurality of movable electrodes 6 protrudes from an outer edge of the mounting portion 3. In one embodiment, the diaphragm 2 has a circular shape, and axis extension lines of the plurality of the movable electrodes 6 are concentrated at the center of the vibrating portion.

The plurality of first fixed electrodes 4 are connected to the base 1, and the first fixed electrodes 4 and the movable electrodes 6 are spatially separated from, cross and face each other. In one embodiment, the plurality of first fixed electrodes is annularly arranged at equal intervals around the axis of the cavity 11, and axis extension lines of the plurality of first fixed electrodes 4 are concentrated at the center of the cavity 11.

The first capacitor is formed by the first fixed electrodes 4 and the movable electrodes 6. Both the first fixed electrodes 4 and the movable electrodes 6 are arranged in a comb-tooth shape, and the first fixed electrodes 4 are spatially separated from and cross the movable electrodes 6. The contours of the first fixed electrodes 4 and the movable electrodes 6 define an overlapping area. When the diaphragm 2 moves up and down, the overlapping area changes and thus the capacitance of the sensor changes. In this way, a certain relationship can be established between the capacitance change and the input pressure sound wave driving the diaphragm 2, and the first capacitor outputs a first electrical signal to the circuit board.

The plurality of second fixed electrodes 5 are connected to the base 1. In one embodiment, the plurality of first fixed electrodes 4 one-to-one corresponds to the plurality of second fixed electrodes 5, and the second fixed electrodes 5 are spatially separated from and cross the movable electrodes 6. In this embodiment, the plurality of second fixed electrodes 5 is arranged at equal intervals around the axis of the cavity 11, and axis extension lines of the second fixed electrodes 5 are concentrated at the center of the cavity 11.

The second capacitor is formed by the second fixed electrodes 5 and the movable electrodes 6. Both the second fixed electrodes 5 and the movable electrodes 6 are arranged in a comb-tooth shape, and the second fixed electrodes 5 are separated from and cross the movable electrodes 6. The counters of the second fixed electrodes 5 and the movable electrodes 6 define an overlapping area. When the diaphragm 2 moves up and down, the overlapping area changes and the capacitance of the sensor changes. In this way, a certain relationship can be established between the capacitance change and the input pressure sound wave driving the diaphragm 2, and the second capacitor outputs a second electrical signal to the circuit board.

In this embodiment, the first capacitor is formed by the first fixed electrodes 4 and the movable electrodes 6, and the second capacitor is formed by the second fixed electrodes 5 and the movable electrodes 6. The first electrical signal output by the first capacitor and the second electrical signal output by the capacitor forms a differential output. The dual capacitor electrical signal differential output mode of the condenser microphone of the present invention can greatly increase the sensitivity and a better capacity in suppressing linear distortion, so that the condenser microphone obtains a higher signal-to-noise ratio, better capacity in suppressing linear distortion, and at the same time improves anti-interference capacity of the microphone, thereby achieving longer signal transmission distance and better audio performance of the microphone.

In addition, opposite ends of the connector 31 are respectively connected to the center of the mounting portion 3 and the center of the diaphragm 2, the axis of the mounting portion 3 coincides with the axis of the diaphragm 2, and the connector 31 is arranged on the axis so that the mounting portion 3 and the diaphragm 2 move up and down at the same frequency.

Figure 6:
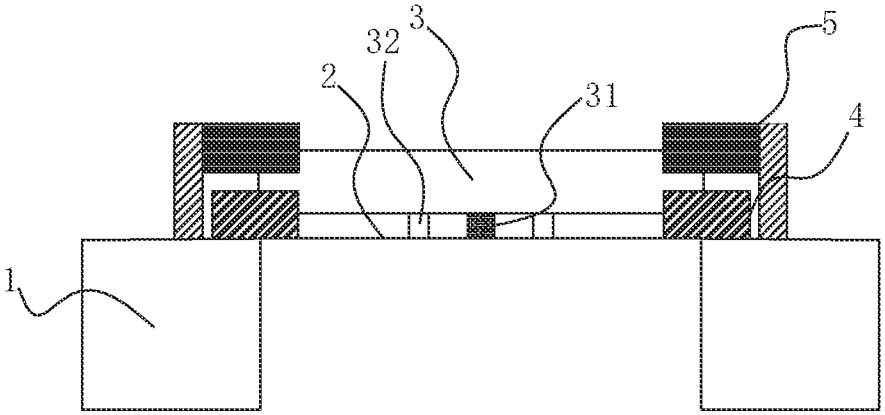
FIG. 6 is a cross-sectional view of the first structure having a connection ring according to an embodiment of the present invention.
Figure 7:
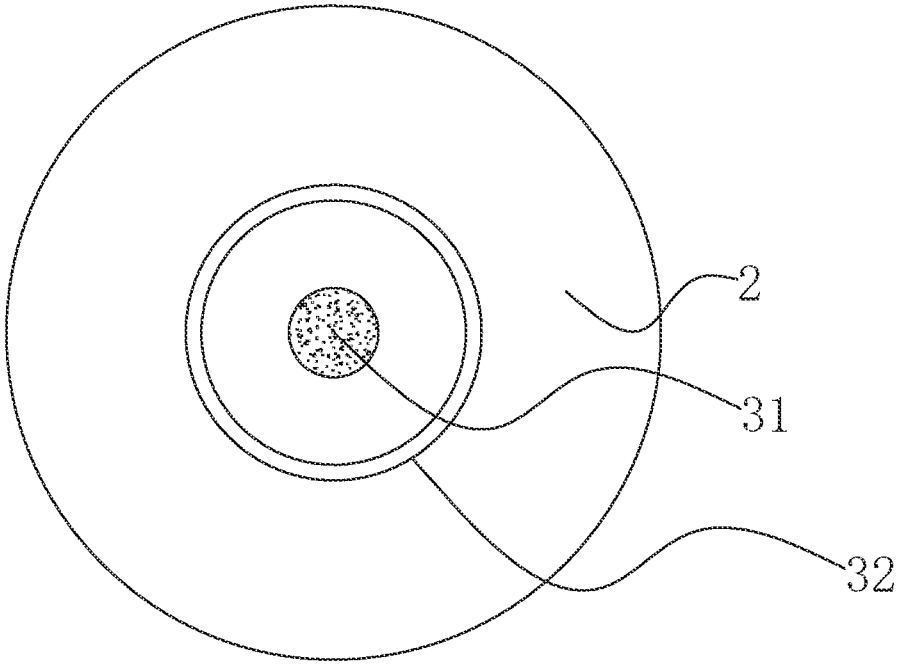
FIG. 7 is a top view of the first structure having a connection ring according to an embodiment of the present invention.

As shown in FIGS. 6 and 7, in order to further ensure the synchronous displacement of the mounting portion 3 and the diaphragm 2 and, at the same time, limit the deviation of the diaphragm 2, a connection ring 32 is also provided. An axis of the connection ring 32 coincides with the axis of the connector 31, and opposite ends of the connection ring 32 are connected to the diaphragm 2 and the mounting portion 3, respectively. The shape of the connection ring 32 can be a complete ring, or it can also be several connection rings, or several connection structure, in order to maintain the stability of the mounting portion 3, and to find a good balance between stability and sensitivity.

In this embodiment, the first fixed electrodes 4 and the second fixed electrodes 5 can be arranged above the cavity 11 or in the cavity 11. The plurality of first fixed electrodes 4 and the plurality of second fixed electrodes 5 are arranged opposite to and spaced from each other along a vibration direction of the diaphragm.

Figure 2:
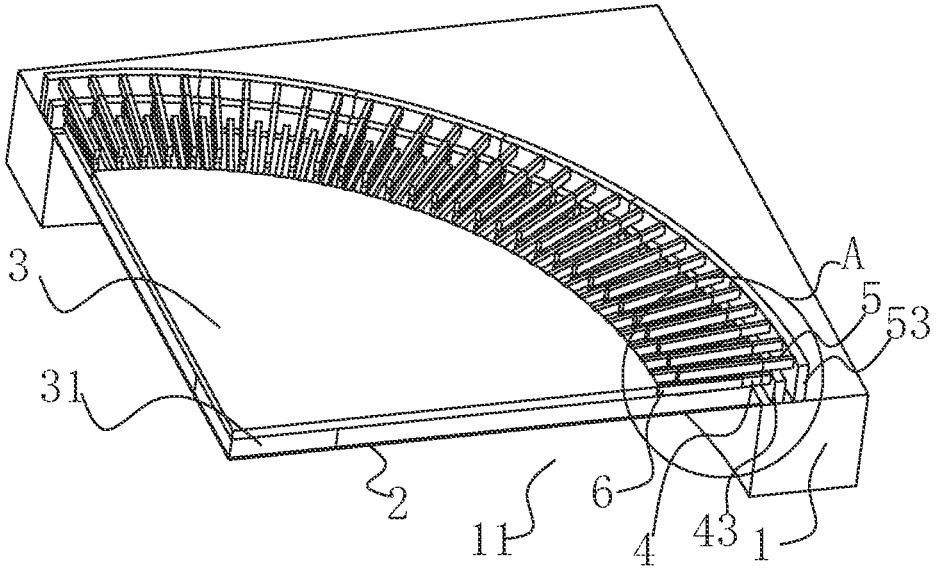
FIG. 2 is a local axonometric view of a first structure according to an embodiment of the present invention.
Figure 3:
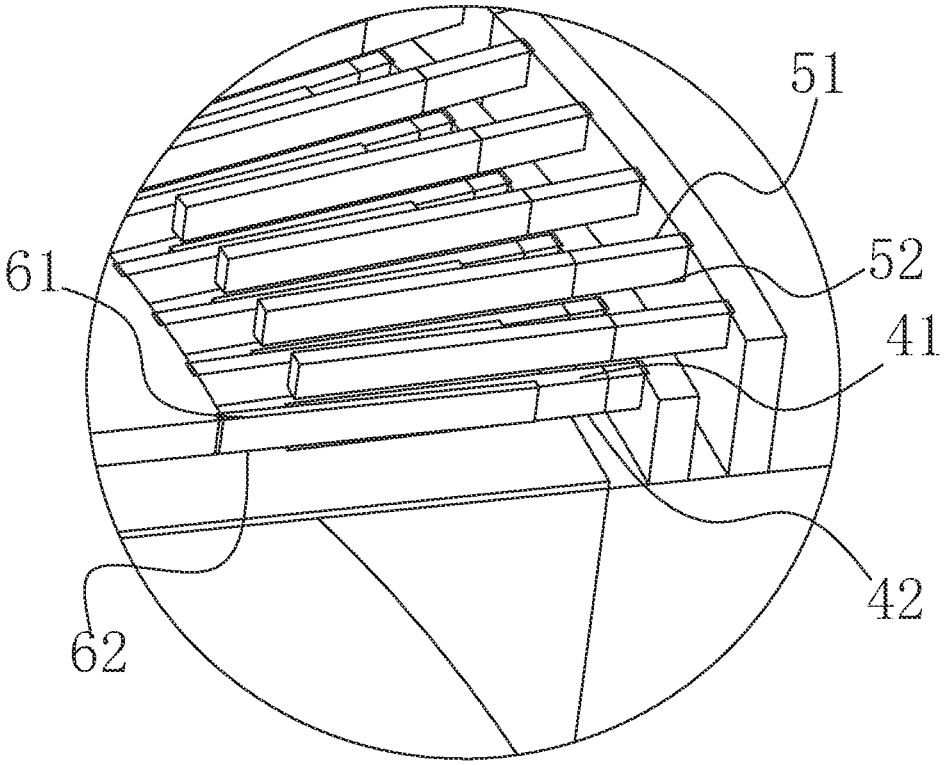
FIG. 3 is an enlarged view of portion A in FIG. 2.
Figure 4:
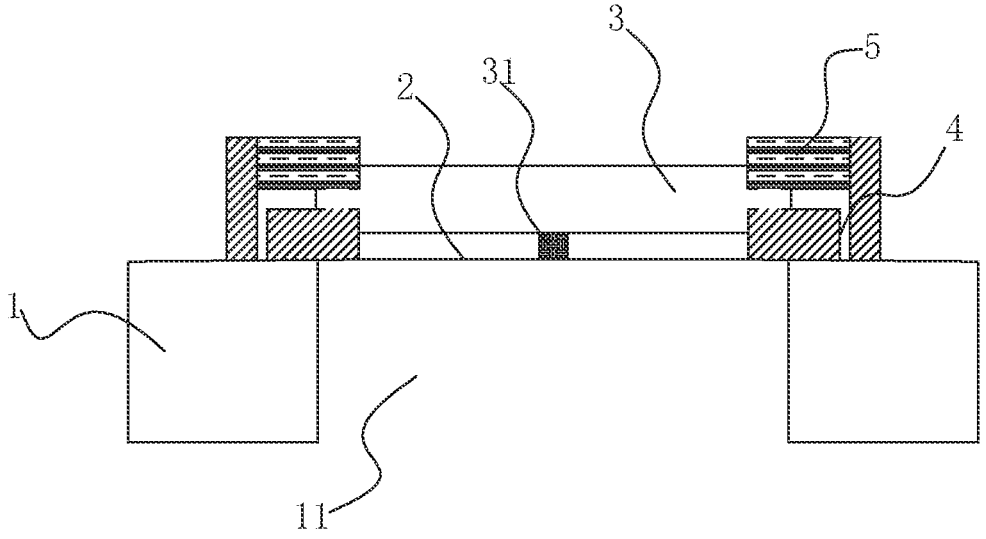
FIG. 4 is a cross-sectional view of a diaphragm of the first structure according to an embodiment of the present invention when the diaphragm is in a stationary state.
Figure 5:
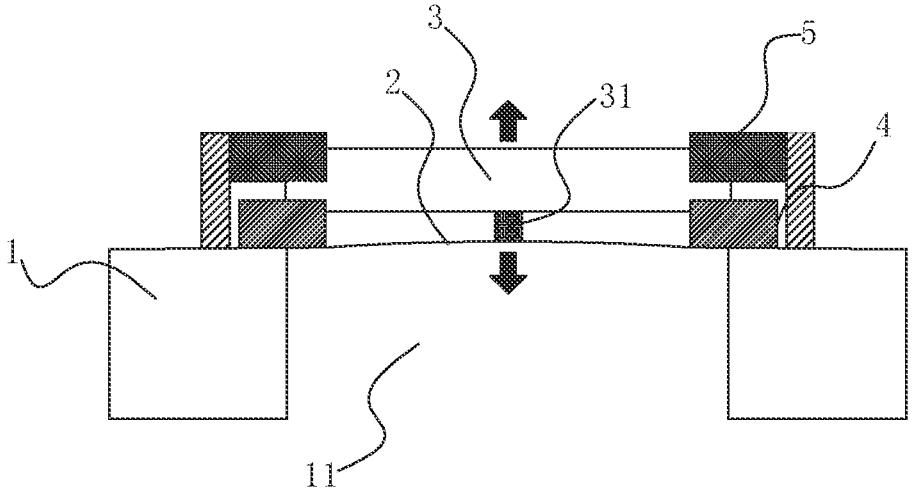
FIG. 5 is a cross-sectional view of a diaphragm of the first structure according to an embodiment of the present invention when the diaphragm is in a movable state.

FIG. 2 is a local axonometric view of a first structure according to an embodiment of the present invention, when the first fixed electrodes 4 and the second fixed electrodes 5 are arranged above the cavity 11, the mounting portion 3 is located above the diaphragm 2. The first fixed electrodes 4 are provided on an end surface of the base 1 through a first support arm 43, the first fixed electrodes 4 can also be fixed directly on the end surface of the base 1 as shown in FIG. 3, and the second fixed electrodes 5 are provided on the end surface of the base 1 through a second support arm 53. The first fixed electrodes 4 are closer to the diaphragm 2 than the second fixed electrodes 5. One of the plurality of first fixed electrodes 4 and one of the plurality of second fixed electrodes 5 are arranged between any adjacent two of the plurality of movable electrodes 6. And the movable electrode 6 has a same distance to two adjacent first fixed electrodes 4 and has a same distance to two adjacent second fixed electrodes 5. Preferably, the plurality of first fixed electrodes 4 and the plurality of second fixed electrodes 5 have a same thickness along the vibration direction of the diaphragm. It can be understood that, in other embodiments, the thickness of the plurality of first fixed electrodes 4 and the plurality of second fixed electrodes 5 along the vibration direction of the diaphragm can also be different.

Figure 10:
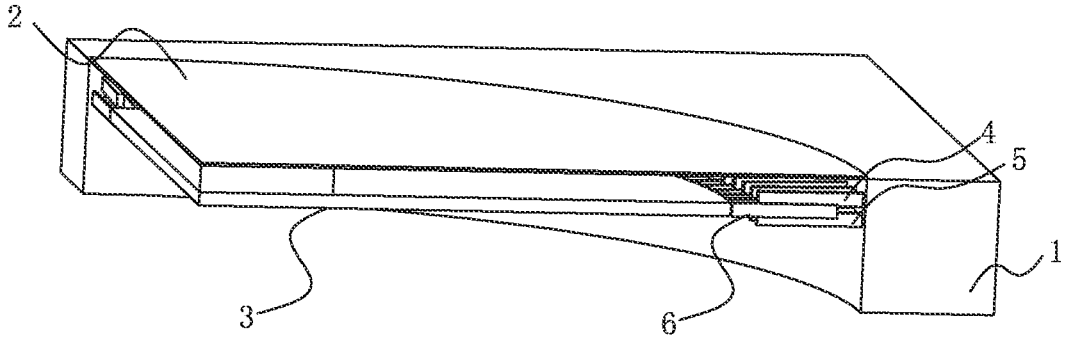
FIG. 10 is a local axonometric view of a second structure according to an embodiment of the present invention.

FIG. 10 is a local axonometric view of a second structure according to an embodiment of the present invention, when the first fixed electrodes 4 and the second fixed electrodes 5 are arranged in the cavity 11, the mounting portion 3 is located below the diaphragm 2, so the first fixed electrodes 4 and the second fixed electrodes 5 are both fixed on a wall surface of the cavity 11, and in this embodiment, the first fixed electrodes 4 are closer to the diaphragm 2 than the second fixed electrodes 5 along the vibration direction of the diaphragm. One of the plurality of first fixed electrodes 4 and one of the plurality of second fixed electrodes 5 are arranged between any adjacent two of the plurality of movable electrodes 6. And the movable electrode 6 has a same distance to two adjacent first fixed electrodes 4 and has a same distance to two adjacent second fixed electrodes 5. Preferably, the plurality of first fixed electrodes 4 and the plurality of second fixed electrodes 5 have a same thickness along the vibration direction of the diaphragm.

Figure 8:
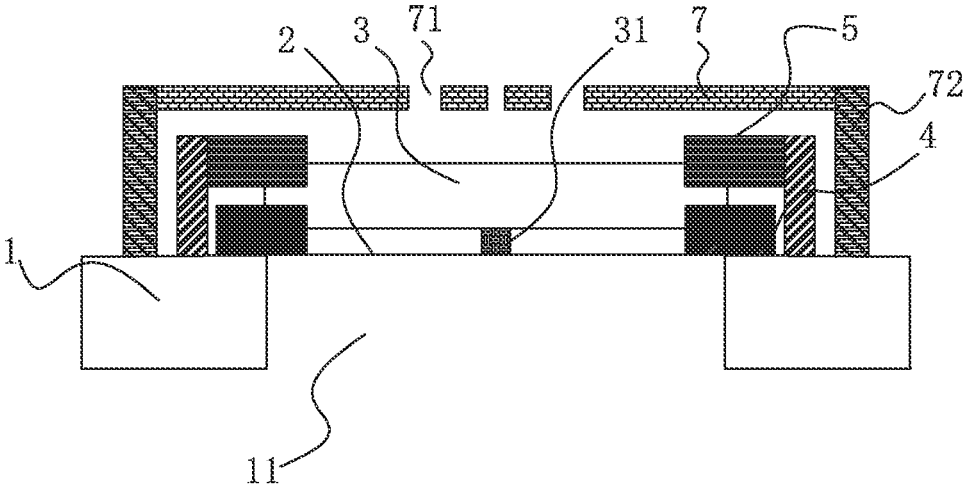
FIG. 8 is a cross-sectional view of the first structure having a backplate according to an embodiment of the present invention.
Figure 9:
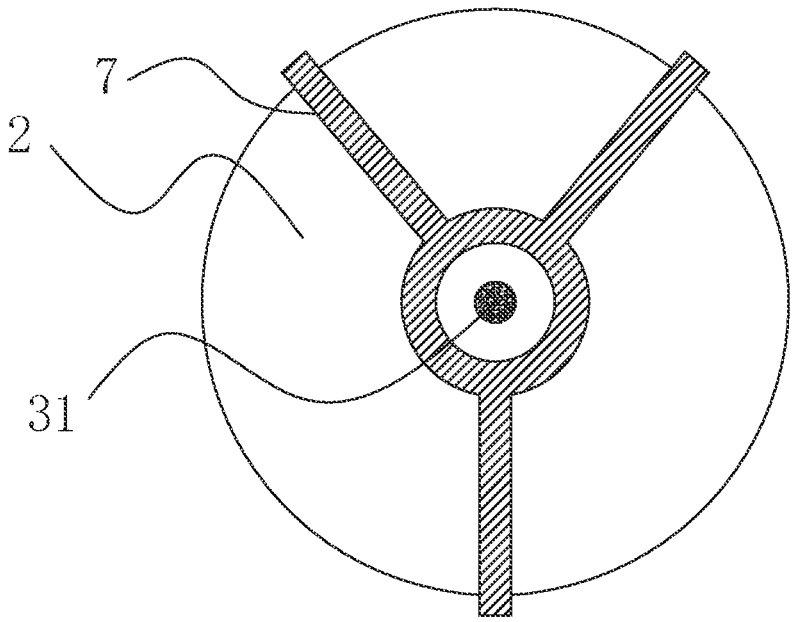
FIG. 9 is a top view of the first structure having a backplate according to an embodiment of the present invention.

As shown in FIGS. 8 and 9, in order to limit the vertical position of the movable structure of the diaphragm 2 and add an electrostatic feedback, a backplate 7 is also provided. The backplate 7 has a plurality of sound holes 71 penetrating therethrough. The plate 7 is arranged on the base 1 through a spacer 72 to form a predetermined gap with the diaphragm 2. When the diaphragm 2 deviates to a certain extent under the sound pressure shock wave, the diaphragm 2 will contact the surface of the backplate 7, thereby restricting the diaphragm 2 from further deflection.

As shown in FIG. 2, the first fixed electrode 4 includes a first top surface 41 and a first bottom surface 42 that are opposite to each other along the vibration direction of the diaphragm. The second fixed electrode 5 includes a second top surface 51 and a second bottom surface 52 that are opposite to each other along the vibration direction of the diaphragm. The movable electrode 6 includes a third top surface 61 and a third bottom surface 62 that are opposite to each other along the vibration direction of the diaphragm. The first top surface 41, the third top surface 61 and the second top surface 51 are sequentially arranged along a direction facing away from the diaphragm.

Since the value of the capacitor is directly proportional to the area between the two plates of the capacitor and inversely proportional to the distance between the two plates of the capacitor, that is, $C=k\varepsilon_0\varepsilon_r S/d$, where k is a constant value, $\varepsilon_0$ is a constant value, and $\varepsilon_r$ is a constant value, S is the adjacent area of faces of the plates facing each other, and d is the distance between the two electric plates. When the condenser microphone is manufactured, the value of $\varepsilon_0\varepsilon_r$ will be fixed.

Taking the first capacitor formed by the first fixed electrodes 4 and the movable electrodes 6 as an example, the first fixed electrodes 4 and the movable electrodes 6 are both arranged in a comb-tooth shape, and the first fixed electrode 4 and the movable electrode 6 are spatially separated from and cross each other. After the first fixed electrodes 4 and the movable electrodes 6 are energized, a capacitance is formed between the first fixed electrodes 4 and the movable electrodes 6, and the distance d therebetween remains unchanged. The area depends on the facing area between the first thickness and the third thickness, thereby bringing good linearity for the microphone according to the present invention. At the same time, since the size of the capacitor is basically not limited by the size of the diaphragm 2, the structure of the diaphragm 2 can be effectively reduced or increased, which is convenient for the development of miniaturization or suppressing miniaturization.

In one embodiment of the present invention, the first thickness, the second thickness and the third thickness are all the same, which can further improve the performance of the microphone.

The structure, features, and effects of the invention are described above in detail based on the embodiments shown in the drawings. The above description only shows some embodiments of the present invention, and will not limit the scope of the present invention. Any modification made in accordance with the concept of the present invention or equivalent embodiments with equivalent variations shall fall within the protection scope of the present invention.

What is claimed is:

1. A differential condenser microphone, comprising:

a base having a cavity passing through the base;

a diaphragm connected to the base and covering the cavity;

a mounting portion connected to the diaphragm through a connector, wherein a plurality of movable electrodes protrudes from an outer edge of the mounting portion;

a plurality of first fixed electrodes connected to the base, wherein the plurality of first fixed electrodes and the plurality of movable electrodes are spatially separated from and cross each other; and a plurality of second fixed electrodes connected to the base, wherein the plurality of second fixed electrodes and the plurality of movable electrodes are separated from, cross and face each other, the plurality of first fixed electrodes and the plurality of second fixed electrodes are arranged opposite to and spaced from each other along a vibration direction of the diaphragm;

wherein both the plurality of first fixed electrodes and the plurality of second fixed electrodes are fixed on a wall surface of the cavity, or the plurality of first fixed electrodes is provided on an end surface of the base through a first support arm, the plurality of second fixed electrodes is provided on the end surface of the base through a second support arm; and the plurality of first fixed electrodes is arranged closer to the diaphragm than the plurality of second fixed electrodes.

2. The differential condenser microphone as described in claim 1, wherein opposite ends of the connector are connected to a center of the mounting portion and a center of the diaphragm, respectively.

3. The differential condenser microphone as described in claim 1, further comprising a connection ring, wherein an axis of the connection ring coincides with an axis of the connector, and opposite ends of the connection ring are connected to the diaphragm and the mounting portion, respectively.

4. The differential condenser microphone as described in claim 1, further comprising a backplate connected to the base by a spacer to form a set gap with the diaphragm, wherein a plurality of sound holes is provided penetrating through the backplate.

5. The differential condenser microphone as described in claim 1, wherein the plurality of first fixed electrodes one-to-one corresponds to the plurality of second fixed electrodes.

6. The differential condenser microphone as described in claim 5, wherein one of the plurality of first fixed electrodes and one of the plurality of second fixed electrodes are arranged between any adjacent two of the plurality of movable electrodes.

7. The differential condenser microphone as described in claim 6, wherein the movable electrode has a same distance to two adjacent first fixed electrodes and has a same distance to two adjacent second fixed electrodes.

8. The differential condenser microphone as described in claim 1, wherein the plurality of first fixed electrodes and the plurality of second fixed electrodes have a same thickness along the vibration direction of the diaphragm.

9. The differential condenser microphone as described in claim 8, wherein each of the plurality of first fixed electrode comprises a first top surface and a first bottom surface that are opposite to each other along the vibration direction of the diaphragm;

each of the plurality of second fixed electrode comprises a second top surface and a second bottom surface that are opposite to each other along the vibration direction of the diaphragm;

each of the plurality of movable electrode comprises a third top surface and a third bottom surface that are opposite to each other along the vibration direction of the diaphragm; wherein the first top surface, the third top surface and the second top surface are sequentially arranged along a direction facing away from the diaphragm.

10. The differential condenser microphone as described in claim 1, wherein the diaphragm has a shape in central symmetry.

11. The differential condenser microphone as described in claim 10, wherein the shape of the diaphragm is a circle or a square.

* * * * *